US006964707B2

(12) United States Patent
Taniguchi et al.

(10) Patent No.: US 6,964,707 B2
(45) Date of Patent: Nov. 15, 2005

(54) ADHESIVE COATING DEVICE

(75) Inventors: Chiharu Taniguchi, Wakayama (JP); Yoshihide Sugiyama, Wakayama (JP)

(73) Assignee: Duplo Seiko Corporation, Wakayama (JP)

( * ) Notice: Subject to any disclaimer, the term of this patent is extended or adjusted under 35 U.S.C. 154(b) by 7 days.

(21) Appl. No.: 10/482,283

(22) PCT Filed: Jun. 24, 2002

(86) PCT No.: PCT/JP02/06264

§ 371 (c)(1),
(2), (4) Date: Dec. 29, 2003

(87) PCT Pub. No.: WO03/002266

PCT Pub. Date: Jan. 9, 2003

(65) Prior Publication Data

US 2004/0188022 A1 Sep. 30, 2004

(30) Foreign Application Priority Data

Jun. 29, 2001 (JP) ..... 2001-198523

(51) Int. Cl.[7] ..... B05C 1/08

(52) U.S. Cl. ..... 118/244; 118/256; 118/259; 156/578; 156/908; 412/37

(58) Field of Search ..... 118/244, 256, 259; 156/578, 908; 412/8, 37, 33; 427/428, 428.2

(56) References Cited

U.S. PATENT DOCUMENTS 5,219,453 A * 6/1993 Furukawa et al. ..... 412/33
6,651,560 B2 * 11/2003 Neuhaus ..... 101/401.1

FOREIGN PATENT DOCUMENTS

| | | |
|---|---|---|
| JP | 4-338259 | 11/1992 |
| JP | 6-199070 | 7/1994 |
| JP | 11-59015 | 3/1999 |
| JP | 2000-190655 | 7/2000 |
| JP | 2001-10250 | 1/2001 |
| JP | 2001-138664 | 5/2001 |

* cited by examiner

*Primary Examiner*—Laura Edwards

(74) *Attorney, Agent, or Firm*—Buchanan Ingersoll PC

(57) ABSTRACT

The present invention relates to an adhesive coating device for sheet-binding provided with a roller 14, part of which is immersed in adhesive 10 stored in an adhesive reservoir 12, for applying hot-melted adhesive 10 in the above-mentioned adhesive reservoir 12 along the arranged one-side edge of a bundle of sheets 54 while rotating. The device includes an electromagnetic induction heating coil 20 disposed in the vicinity of the above-mentioned roller 14, and a current supply device 5 for supplying a high-frequency current to the above-mentioned electromagnetic induction heating coil 20. The above-mentioned roller 14 is formed of a heating member for generating heat using the Joule heat owing to an eddy current caused by a high-frequency magnetic flux generated by the above-mentioned electromagnetic induction heating coil 20, and the above-mentioned roller 14 is heated by supplying a current from the above-mentioned current supply device 51 to the above-mentioned electromagnetic induction heating coil 20 so that the adhesive 10 stored in the above-mentioned adhesive reservoir 12 is melted.

20 Claims, 12 Drawing Sheets

54
56
14
12
52
58

81
80

81
82

81
83

81
83

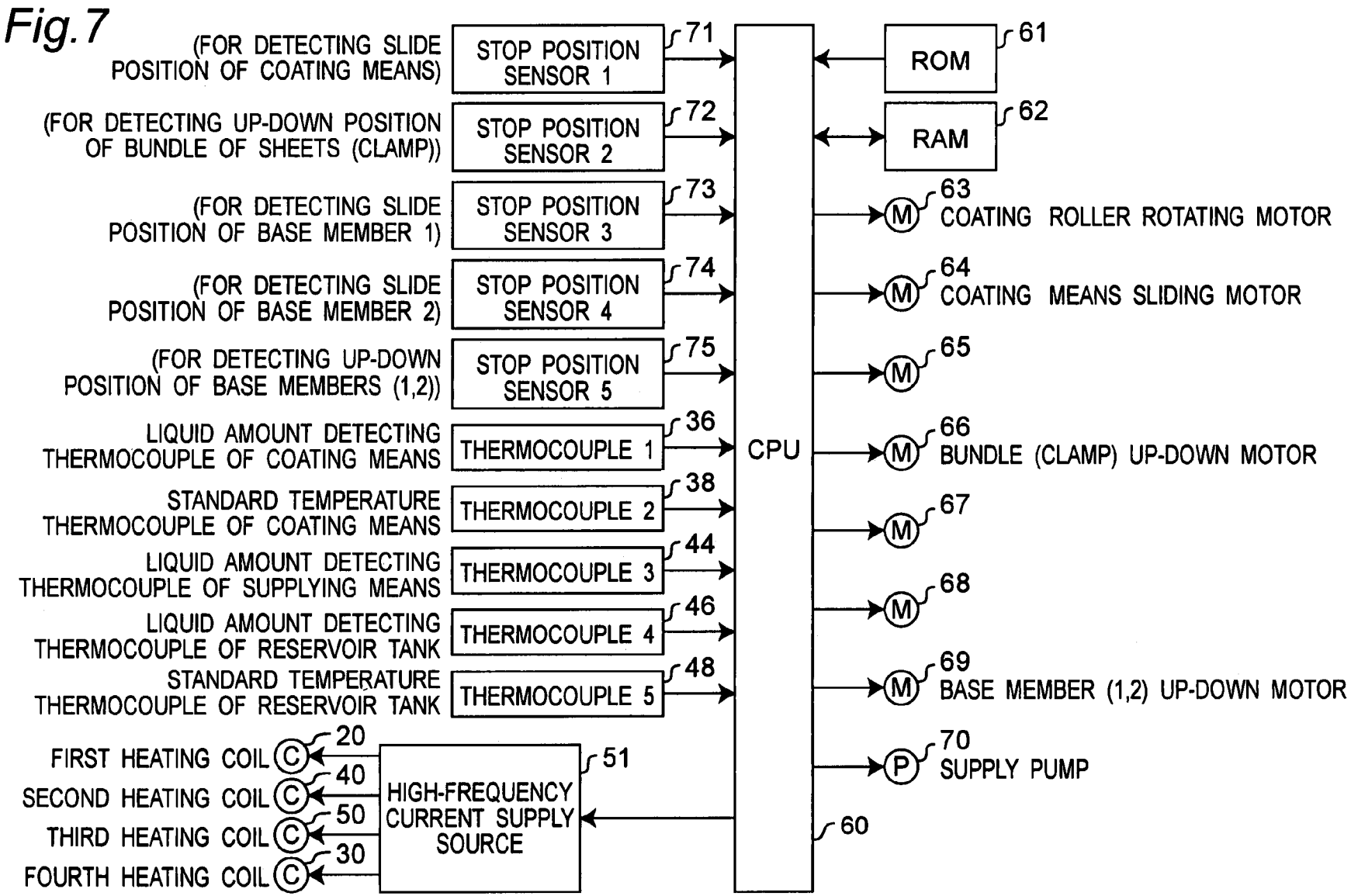
Fig.7
(FOR DETECTING SLIDE POSITION OF COATING MEANS)
(FOR DETECTING UP-DOWN POSITION OF BUNDLE OF SHEETS (CLAMP))
(FOR DETECTING SLIDE POSITION OF BASE MEMBER 1)
(FOR DETECTING SLIDE POSITION OF BASE MEMBER 2)
(FOR DETECTING UP-DOWN POSITION OF BASE MEMBERS (1,2))
LIQUID AMOUNT DETECTING THERMOCOUPLE OF COATING MEANS
STANDARD TEMPERATURE THERMOCOUPLE OF COATING MEANS
LIQUID AMOUNT DETECTING THERMOCOUPLE OF SUPPLYING MEANS
LIQUID AMOUNT DETECTING THERMOCOUPLE OF RESERVOIR TANK
STANDARD TEMPERATURE THERMOCOUPLE OF RESERVOIR TANK
FIRST HEATING COIL
SECOND HEATING COIL
THIRD HEATING COIL
FOURTH HEATING COIL
20
40
50
30
STOP POSITION SENSOR 1
STOP POSITION SENSOR 2
STOP POSITION SENSOR 3
STOP POSITION SENSOR 4
STOP POSITION SENSOR 5
THERMOCOUPLE 1
THERMOCOUPLE 2
THERMOCOUPLE 3
THERMOCOUPLE 4
THERMOCOUPLE 5
HIGH-FREQUENCY CURRENT SUPPLY SOURCE
51
71
72
73
74
75
36
38
44
46
48
CPU
60
ROM
RAM
61
62
63 COATING ROLLER ROTATING MOTOR
64 COATING MEANS SLIDING MOTOR
65
66 BUNDLE (CLAMP) UP-DOWN MOTOR
67
68
69 BASE MEMBER (1,2) UP-DOWN MOTOR
70 SUPPLY PUMP

ADHESIVE COATING DEVICE

TECHNICAL FIELD

The present invention relates to an adhesive coating device used in a sheet-binding device and more particularly to a device for melting hot-meltable solid adhesive and applying the adhesive to the one-side edge of a bundle of sheets serving as the back of a book in a sheet-binding process.

BACKGROUND ART

Conventionally, a sheet-binding device or the like for applying adhesive to the back of a bundle of printed sheets and binding the sheets has an adhesive coating device provided with an adhesive reservoir for storing hot-melt adhesive and a coating roller disposed so that part thereof is immersed in the adhesive stored in the adhesive reservoir and so that the roller is journaled to be rotatable in the adhesive reservoir. The above-mentioned device, having been used in the mainstream, is provided with a heater in the adhesive reservoir so that the heater heats the adhesive to melt the adhesive.

However, in such indirect heating means as that uses the above-mentioned heater, the efficiency of heat transfer is low; three steps of heat transfer, from the heater to the adhesive reservoir, from the adhesive reservoir to the adhesive and from the adhesive to the coating roller, are required to sufficiently heat the coating roller, which serves as a member for directly applying the adhesive to the back of the bundle of sheets, to a predetermined temperature. Hence, it takes a long time until a standby state is attained, and it is difficult to accurately control the final temperature of the coating roller from the heater serving as a heat source. In addition, since the roller serving as a secondary heating member is required to be capable of carrying out heat transfer and to have a volume capable of sufficiently storing heat, it is necessary to increase the volume of the roller; as a result, the whole device becomes larger in size. Therefore, the atmospheric exposure area of the adhesive in the adhesive reservoir is required to be increased, causing problems of bad-smelling and the like.

Furthermore, in consideration of the efficiency of heat transfer, it is ideal that the coating roller can be heated directly and that the adhesive reservoir can be heated subordinately; this can make temperature control easy. This type of device is available as a device wherein, in addition to the heating of the adhesive reservoir using a heater, the coating roller is configured so as to be hollow and a halogen lamp is embedded therein.

However, in this type of device, the configuration of the coating roller itself becomes massive, resulting in making the whole device larger in size; in addition, since the coating roller is structured to rotate around its shaft, there is a problem of wire processing. Furthermore, if adhesive attaches to the halogen lamp, this may cause breakage; therefore, it is necessary to use a structure wherein the halogen heater is replaceable and to provide a seal for preventing the adhesive from entering the open area provided in the coating roller.

DISCLOSURE OF INVENTION (Technical Problems to be Solved by the Invention)

Accordingly, with respect to technical problems to be solved by the present invention, in order to solve the above-mentioned problems, the present invention is intended to provide a compact adhesive coating device capable of directly heating a roller.

(Method of Solving Problems)

To solve the above-mentioned technical problems, the present invention provides an adhesive coating device configured as described below.

The adhesive coating device is provided with a roller, part of which is immersed in adhesive stored in an adhesive reservoir, for applying the adhesive hot-melted in the above-mentioned adhesive reservoir along the arranged one-side edge of a bundle of sheets while rotating. The adhesive coating device is further provided with an electromagnetic induction heating coil disposed in the vicinity of the above-mentioned roller, and a current supply device for supplying a high-frequency current to the above-mentioned electromagnetic induction heating coil, wherein the above-mentioned roller is formed of a heating member for generating heat using a Joule heat owing to an eddy current caused by a high-frequency magnetic flux generated by the above-mentioned electromagnetic induction heating coil, and the above-mentioned current supply device the current to above-mentioned electromagnetic induction heating coil so as to heat the above-mentioned roller so that the adhesive stored in the above-mentioned adhesive reservoir is melted by the above-mentioned roller.

In the above-mentioned configuration wherein the roller is formed of a heating member for generating heat using the Joule heat owing to an eddy current caused by a high-frequency magnetic flux generated by the electromagnetic induction heating coil, a high-frequency current is supplied to the electromagnetic induction heating coil disposed in the vicinity thereof. At this time, it is preferable that the high-frequency current supplied to the electromagnetic induction heating coil has a frequency of 5 to 100 kHz. When the high-frequency current is supplied to the electromagnetic induction heating coil, the roller is heated by the action of electromagnetic induction. In other words, an eddy current is generated in the roller by the high-frequency magnetic flux generated by the electromagnetic induction heating coil, and the roller itself becomes an electric resistor, whereby a calorific value corresponding to the amount of the current supplied to the electromagnetic induction heating coil can be obtained. Hence, the adhesive stored in the adhesive reservoir begins to melt around the roller owing to the heat generation at the roller, whereby the roller can rotate before the whole adhesive in the adhesive reservoir melts. Then, the bundle of sheets is moved relative to the roller, whereby the adhesive can be applied to the back of the bundle of sheets.

In the above-mentioned configuration, since the roller is directly heated by the electromagnetic induction heating coil, heat transfer is done excellently, whereby the roller can be rotated in a relatively short time after the start of operation. Hence, the adhesive can be stirred earlier, whereby a time period until a standby state is attained can be shortened. In addition, the temperature of the roller can be adjusted easily by adjusting the amount of the current supplied to the electromagnetic induction heating coil, whereby temperature control can be carried out easily and the response of the control is excellent.

Furthermore, the heating coil can directly heat the roller although it does not make contact with the roller, whereby the wiring processing at the drive section can be facilitated and the roller can be made smaller. It is preferable that the diameter of the roller is about $\phi$ 10 to $\phi$ 100 mm. Since the resistance value of the roller is determined depending on the cross-sectional area of the metal portion of the roller, a smaller roller having a smaller cross-sectional area can have higher output, and the skin effect of the eddy current can be used. Hence, this results in making the device smaller and lighter. Still further, since the roller and the adhesive reservoir can be made smaller, the atmospheric exposure area of the adhesive can be minimized, whereby the occurrence of bad-smelling can be minimized.

The adhesive coating device of the present invention can be specifically configured in various modes of embodiments described below.

Preferably, the above-mentioned electromagnetic induction heating coil is disposed in the direction of the rotation shaft of the above-mentioned roller, the above-mentioned roller is configured so as to be hollow, and a side face thereof on a side wherein the above-mentioned electromagnetic induction heating coil is provided is made of a nonmagnetic substance.

In the above-mentioned configuration, the electromagnetic induction heating coil is not disposed in the peripheral direction of the roller but disposed on the side of the rotation shaft, that is, disposed so as to face the bottom face of the roller. In addition, the roller is configured so as to be hollow, and the face thereof on the side wherein the electromagnetic induction heating coil is disposed is made of a nonmagnetic substance, whereby the cylindrical roller with a bottom is disposed so as to be open in the direction toward the coil as viewed from the electromagnetic induction heating coil and an eddy current flows along the whole wall thereof. In addition, the side face on the side of the coil is sealed by a wall made of a nonmagnetic substance, whereby the adhesive can be prevented from entering the inside of the roller.

With the above-mentioned configuration, since the eddy current can flow around the whole peripheral wall of the roller, the roller can be heated quickly. Hence, a starting time period can be shortened.

Preferably, a core is disposed in a vicinity of the above-mentioned electromagnetic induction heating coil.

With the above-mentioned configuration, the magnetic flux of the coil generated on the side wherein the roller is not disposed can be converged; as a result, the efficiency of electromagnetic induction heating can be improved.

Preferably, the adhesive coating device further comprises a reservoir tank for replenishing the above-mentioned adhesive.

With the above-mentioned configuration, the adhesive is supplied from the reservoir tank; this saves the user from having to replenish the adhesive.

In the above-mentioned configuration, preferably, the adhesive coating device further comprises an adhesive detecting device for detecting an amount of the adhesive stored in the above-mentioned adhesive reservoir, replenishing member, disposed in the middle of an adhesive supply passage for connecting the above-mentioned reservoir tank to the above-mentioned adhesive reservoir, for replenishing the adhesive stored in the above-mentioned reservoir tank into the above-mentioned adhesive reservoir, and a replenishing control device for properly keeping a replenishing amount of the adhesive by receiving a signal from the above-mentioned adhesive amount detecting device and by driving the above-mentioned replenishing member.

In the above-mentioned configuration, thermocouples or floats, for example, can be used as the adhesive detecting device. When the reduction of the adhesive in the adhesive reservoir is detected by the adhesive detecting device, a signal is transmitted to the replenishing control device; after receiving this, the replenishing control device drives the replenishing member to replenish the adhesive so that the amount of the adhesive in the adhesive reservoir become proper. Hence, with the above-mentioned configuration, the adhesive replenished to the adhesive reservoir can be controlled.

Preferably, a screw-shaped stirring means is provided in the reservoir tank.

In the above-mentioned configuration, the stirring means is used to stir the melted adhesive stored in the reservoir tank; hence, the adhesive in the reservoir tank can be made uniform and can be fed to the adhesive reservoir.

In the above-mentioned configuration, preferably, the adhesive coating device further comprises a second electromagnetic induction heating coil disposed in a vicinity of the above-mentioned reservoir tank, and a second current supply device for supplying a high-frequency current to the above-mentioned second electromagnetic induction heating coil, wherein the above-mentioned reservoir tank is formed of a heating member for generating heat using the Joule heat owing to an eddy current caused by a high-frequency magnetic flux generated by the above-mentioned electromagnetic induction heating coil, and the above-mentioned current supply device supplies the current to the above-mentioned second electromagnetic induction heating coil so as to heat above-mentioned reservoir tank.

With the above-mentioned configuration, the reservoir tank can be directly heated by the second electromagnetic induction heating coil, whereby start operation can be carried out quickly even when the adhesive is replenished.

Preferably, the adhesive coating device further comprises a third electromagnetic induction heating coil disposed inside the above-mentioned stirring member, and a third current supply device for supplying a high-frequency current to the above-mentioned third electromagnetic induction heating coil, wherein the above-mentioned stirring member is formed of a heating member for generating heat using a Joule heat owing to an eddy current caused by a high-frequency magnetic flux generated by the above-mentioned electromagnetic induction heating coil, and the above-mentioned third current supply device supplies the current to the above-mentioned third electromagnetic induction heating coil so as to heat the above-mentioned stirring member.

With the above-mentioned configuration, the third electromagnetic induction heating coil is disposed inside the above-mentioned stirring means, whereby by flowing a high-frequency current through the heating coil, an eddy current flows in the stirring means existing around the coil, and the stirring means itself becomes an electric resistor and generates heat. Hence, the adhesive in the reservoir tank can be melted quickly; furthermore, by carrying out stirring using the screw-shaped stirring means, adhesive not melted comes to exist around the stirring means, whereby the adhesive can be melted efficiently.

Preferably, the adhesive coating device further comprises a fourth electromagnetic induction heating coil disposed in a vicinity of the above-mentioned adhesive supply passage, and a fourth current supply device for supplying a high-frequency current to the above-mentioned fourth electromagnetic induction heating coil, wherein at least part of the above-mentioned adhesive supply passage is formed of a heating member for generating heat using a Joule heat owing to an eddy current caused by a high-frequency magnetic flux generated by the above-mentioned electromagnetic induction heating coil, and the abovementioned adhesive supply passage is heated by supplying a current from the above-mentioned fourth current supply device to the above-mentioned fourth electromagnetic induction heating coil.

In the above-mentioned configuration, by flowing a high-frequency current through the fourth electromagnetic induction heating coil, an eddy current flows in the adhesive supply passage made of a magnetic substance, and the adhesive supply passage itself becomes an electric resistor and generates heat. Hence, with the above-mentioned configuration, the adhesive melted inside the resistor tank can be supplied to the adhesive resistor without hardening.

Preferably, a core is disposed in the vicinity of or inside at least one of the second, third and fourth electromagnetic induction heating coil.

With the above-mentioned configuration, by disposing the core in the vicinity of or inside the second, third and fourth electromagnetic induction heating coil, the magnetic flux generated on the opposite side of the object to be heated can be converged; as a result, the efficiency of the induction heating can be improved.

Preferably, the above-mentioned adhesive supply passage meanders partially.

With the above-mentioned configuration, the area of contact between the adhesive supply passage heated by the fourth electromagnetic induction heating coil and the adhesive can be increased, whereby the adhesive can be melted stably.

Preferably, the adhesive coating device further comprises moving member for moving the above-mentioned roller, wherein the above-mentioned roller is moved by the above-mentioned moving member to apply the adhesive to a back of the above-mentioned bundle of sheets fixed at a predetermined position.

When the roller in the adhesive reservoir is in a state of being fixed at a predetermined position and the adhesive is applied to the back of the bundle of sheets by moving a damper unit in which the bundle of sheets is held, the stroke of the movement increases because the bundle of sheets has a width in the direction of the movement; as a result, the whole device increases in size. Hence, in the conventional device, it is inevitable that the sizes of the roller and the adhesive reservoir increase as described above; hence, when the roller is configured so as to be moved, this causes a problem of making the whole device still larger in size. In the above-mentioned configuration, however, the roller can be configured so as to be made smaller by electromagnetic induction heating; hence, by moving the roller with respect to the bundle of sheets, the movement should only be done in the range of the width of the bundle of sheets, whereby the stroke can be shortened and the whole device can be made smaller in size.

Preferably, the above-mentioned moving means is operable to move the coating unit including the above-mentioned roller and the above-mentioned adhesive reservoir.

With the above-mentioned configuration, the adhesive reservoir and the roller move as a unit, whereby the adhesive does not drip from the roller, thereby not staining the device.

Preferably, the above-mentioned coating unit does not include the above-mentioned first electromagnetic induction heating coil.

With the above-mentioned configuration, the coating unit is configured so that the whole container excluding the electromagnetic induction heating coil is moved, whereby mechanisms for wire processing and the like can be facilitated. In addition, while the roller makes contact with the one-side edge of a bundle of sheets, the roller is not heated, whereby a time period required for the adhesive to harden after application can be shortened and the sheets making contact with the roller are in no danger of getting burned.

In each of the above-mentioned embodiments, it is most preferable that materials, such as iron, nickel, iron-nickel alloy, nickel-cobalt alloy and magnetic stainless steel, are used as the material of the heating member in consideration of the speed of heat generation; in addition, it is further preferable that a material having a volume resistivity of 5 to 150 Ω·m and a magnetic permeability $\mu_0$ of 10 or more in a vacuum is used. Metals being low in volume resistivity, such as aluminum, copper and brass, can be used in the form of a thin film by means of plating or the like.

BRIEF DESCRIPTION OF DRAWINGS

FIG. 7 is a block diagram showing the control system of the sheet-binding device in accordance with this embodiment.

BEST MODE FOR CARRYING OUT THE INVENTION

Figure 1:
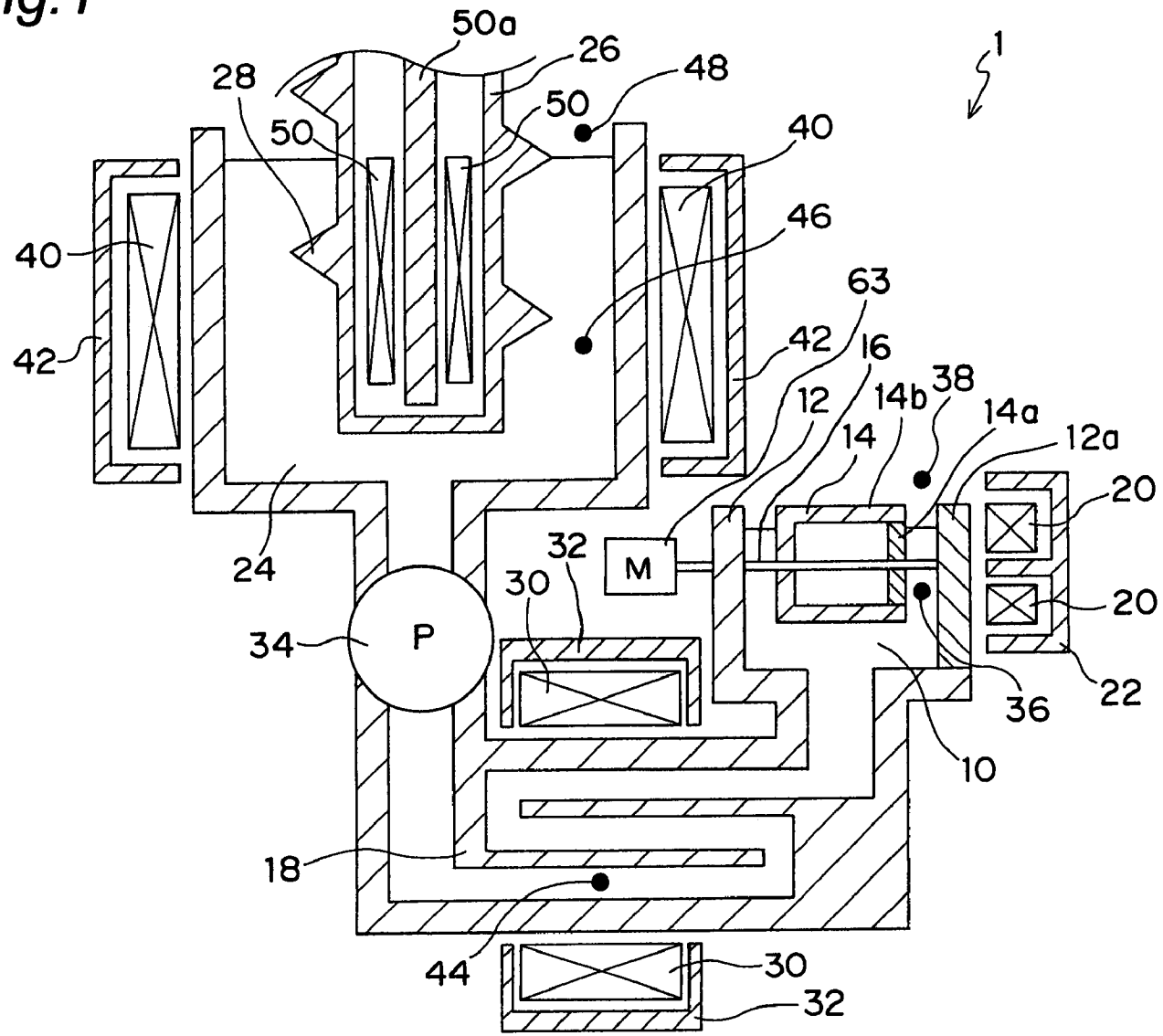
FIG. 1 is a view showing the main configuration of a sheet-binding device in accordance with a first embodiment of the present invention.

A sheet-binding device in accordance with each embodiment of the present invention will be described below referring to the drawings.

FIG. 1 is a view showing the main configuration of a sheet-binding device in accordance with a first embodiment of the present invention. This sheet-binding device 1 comprises an adhesive reservoir 12 for storing hot-melt adhesive 10, a reservoir tank 24 for storing the adhesive to be replenished, and an adhesive supply section 18 for connecting the reservoir tank to the adhesive reservoir. In the adhesive reservoir 12, a roller 14 is provided. The roller 14 is journaled by a shaft 16 so that at least part of the peripheral face thereof is immersed in the adhesive stored inside the adhesive reservoir and that is rotatable around the shaft by a motor 63 connected to the shaft.

On the extension of the shaft 16 of the roller 14, a first heating coil 20 is provided. The roller 14 comprises a cup-shaped member 14*b* made of iron and a plate-shaped section 14*a* made of glass epoxy resin and constituting the side wall on the side facing the first heating coil so as to be configured in a hollow shape as a whole. The plate-shaped section 14*a* completely seals the opening of the cup-shaped member 14*b* to prevent the adhesive 10 from entering the inside of the cup-shaped member 14*b*. Furthermore, the cup-shaped member 14*b* can be made of a material having a volume resistivity of 5 to 150 Ω·m and a magnetic permeability of 10 or more, such as iron, nickel or iron-nickel alloy.

Figure 3:
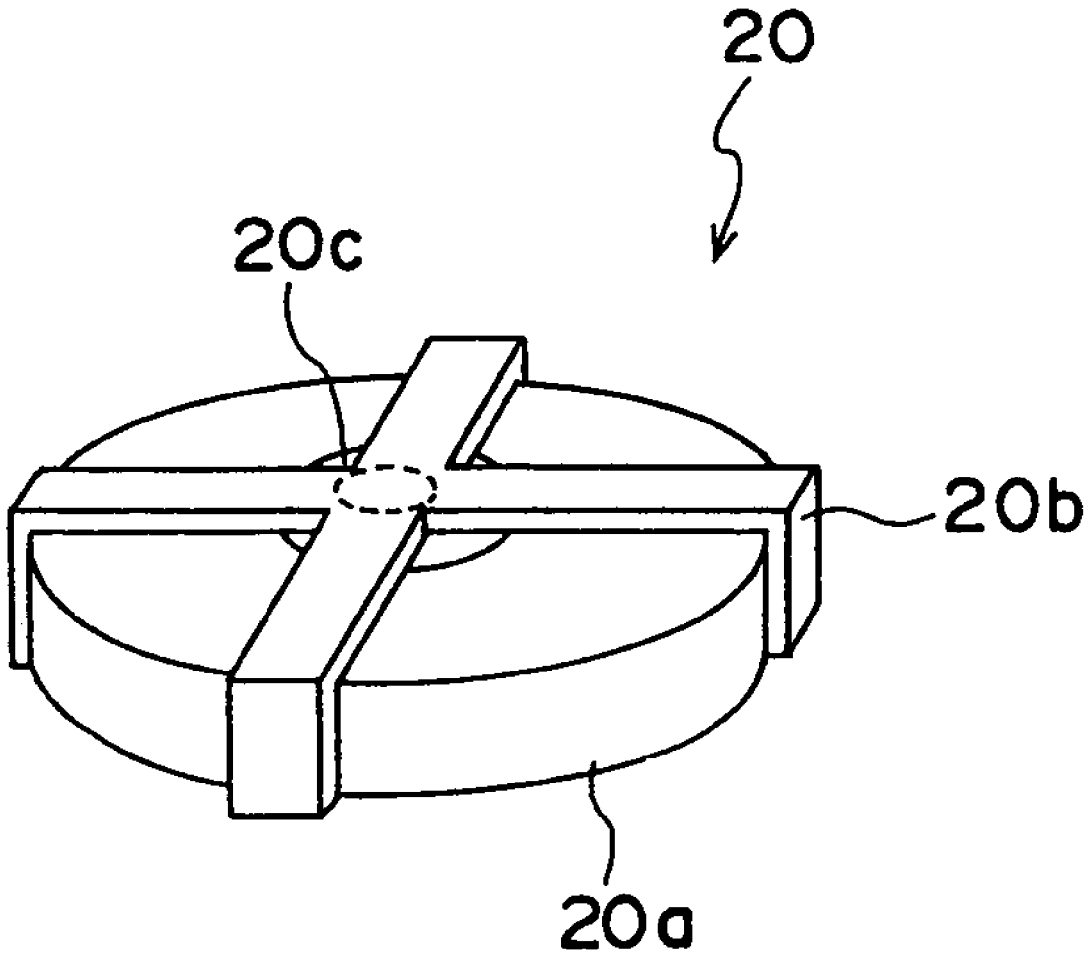
FIG. 3 is a view showing the configuration of a first heating coil.

The first heating coil 20 is configured so as to be able to receive a high-frequency current from a current supply device not shown. When the high-frequency current flows through the first heating coil 20, a magnetic flux is generated around the first heating coil 20. The first heating coil 20 has a ferrite core 22 shown in FIG. 3 to converge the generated magnetic flux. The first heating coil 20 has U-shaped orthogonal ferrite members 20b around a coil bundle 20a and is provided with a rod-shaped ferrite member 20*c* extending from the intersection of the ferrite members 20*b* to the inside of the coil.

The magnetic flux generated by the first heating coil generates an eddy current in the roller 14. By the eddy current flowing through the inside, the roller itself becomes an electric resistor and generates heat depending on the amount of the current flowing through the first heating coil. Since the roller comprises the cup-shaped member 14*b* made of iron, a magnetic substance, and the plate-shaped section 14*a*, a nonmagnetic substance, as described above, the eddy current flows along the wall face of the cup-shaped member 14*b*. Hence, heat generation occurs uniformly around the whole area of the roller 14.

In the sheet-binding device in accordance with this embodiment, the first heating coil directly heats the roller by electromagnetic induction heating; hence, the efficiency of the electromagnetic induction can be raised by reducing the cross-sectional area of the roller serving as an heated part. In other words, the cross-sectional area of the roller can be reduced, whereby the total volume of the device itself can be reduced, and the time for heating can be shortened.

Although the greater part of the adhesive reservoir 12 is made of iron, the side wall 12*a* on the side wherein the first heating coil 20 is provided is made of glass epoxy resin, a nonmagnetic substance, so as not to disturb the magnetic flux generated from the above-mentioned first heating coil. Provided that the side wall 12*a* is made of a nonmagnetic substance, it is not necessary to particularly specify its material. The adhesive 10 in the adhesive reservoir 12 is heated by the roller 14 and begins to melt from around the periphery of the roller.

When the adhesive 10 melts to some extent and the roller 14 is ready to rotate around the shaft 16, the roller 14 moves along the arranged one-side edge of a bundle of sheets clamped with a damper to apply the adhesive 10 as described later.

Figure 2:
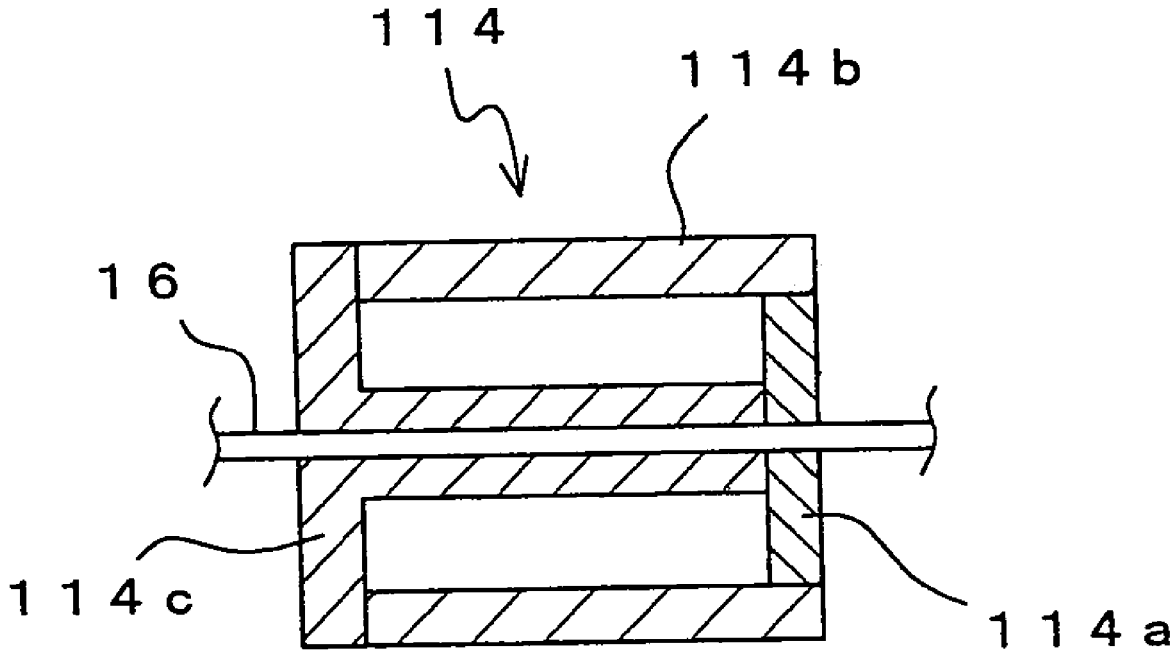
FIG. 2 is a view showing the configuration of a modified example of a roller.

FIG. 2 shows a modified example of the roller. This type of roller 114 comprises three members. In other words, the roller 114 comprises a cylindrical member 114*b* made of iron, a bottom member 114*c* forming a fit portion between the shaft 16 and the side face of the roller farther away from the electromagnetic inductiion heating coil 20, and a plae-shaped section 114*a* made of a nonmagnetic substance and forming the side face of the roller on the side of the electromagnetic induction heating coil 20. The bottom member is made of a material having high magnetic permeability and being hard to allow eddy current to flow, such as ferrite. The plate-shaped section 114*a* and the bottom member 114*c* completely seal the openings of the cylindrical member 114*b* to prevent the adhesive from entering the inside of the cylindrical member 114*b*. With this configuration, an eddy current flows along the cylindrical member 114*b* that makes direct contact with adhesive, whereby the heating efficiency of the cylindrical member 114*b* can be improved.

The reservoir tank 24 is a tank wherein the adhesive, which is supplied when the amount of the adhesive 10 stored in the adhesive reservoir 12 becomes scarce, is stored in a melted state in advance. The reservoir tank 24 is a container made of iron and has two second heating coil 40 in the vicinity thereof.

The second heating coil 40 is configured so as to be able to receive a high-frequency current from a current supply device not shown. When the high-frequency current flows through the second heating coil 40, a magnetic flux is generated around the second heating coil 40. The second heating coil 40 has a ferrite core 42 shown in FIG. 4 to converge the generated magnetic flux. The second heating coil 40 is configured such that "["-shaped ferrite members 40*b* are provided at four positions at 90 degree intervals around a coil bundle 40*a*.

The magnetic flux generated by the second heating coil generates an eddy current in the reservoir tank 24. By the eddy current flowing through the inside, the reservoir tank 24 itself becomes an electric resistor and generates heat depending on the amount of the current flowing through the second heating coil, thereby melting the adhesive stored therein.

The reservoir tank 24 is provided with a screw 26 for stirring the adhesive stored therein. The screw 26 is a slender cylindrical member made of iron and has a projection 28 disposed spirally around its periphery; when the screw is rotated around its longitudinal axis, the projection 28 scrapes out the adhesive around its periphery, thereby stirring the adhesive.

The screw 26 is configured in a hollow shape and provided with a third heating coil 50 therein. The third heating coil is configured so as to be able to receive a high-frequency current from a current supply device not shown. When the current flows through the third heating coil, an eddy current is generated in the screw made of a magnetic substance, and the screw 26 itself is heated. The adhesive around the heated screw 26 receives the heat of the screw and melts.

The adhesive supply section 18 is provided between the adhesive reservoir 12 and the reservoir tank 24. The adhesive supply section 18 is formed of a cylinder made of iron and configured so as to meander, and is provided with a gear pump 34 in the adhesive supply section 18. The adhesive stored in the reservoir tank 24 is fed to the adhesive reservoir when the gear pump is driven.

Figure 4:
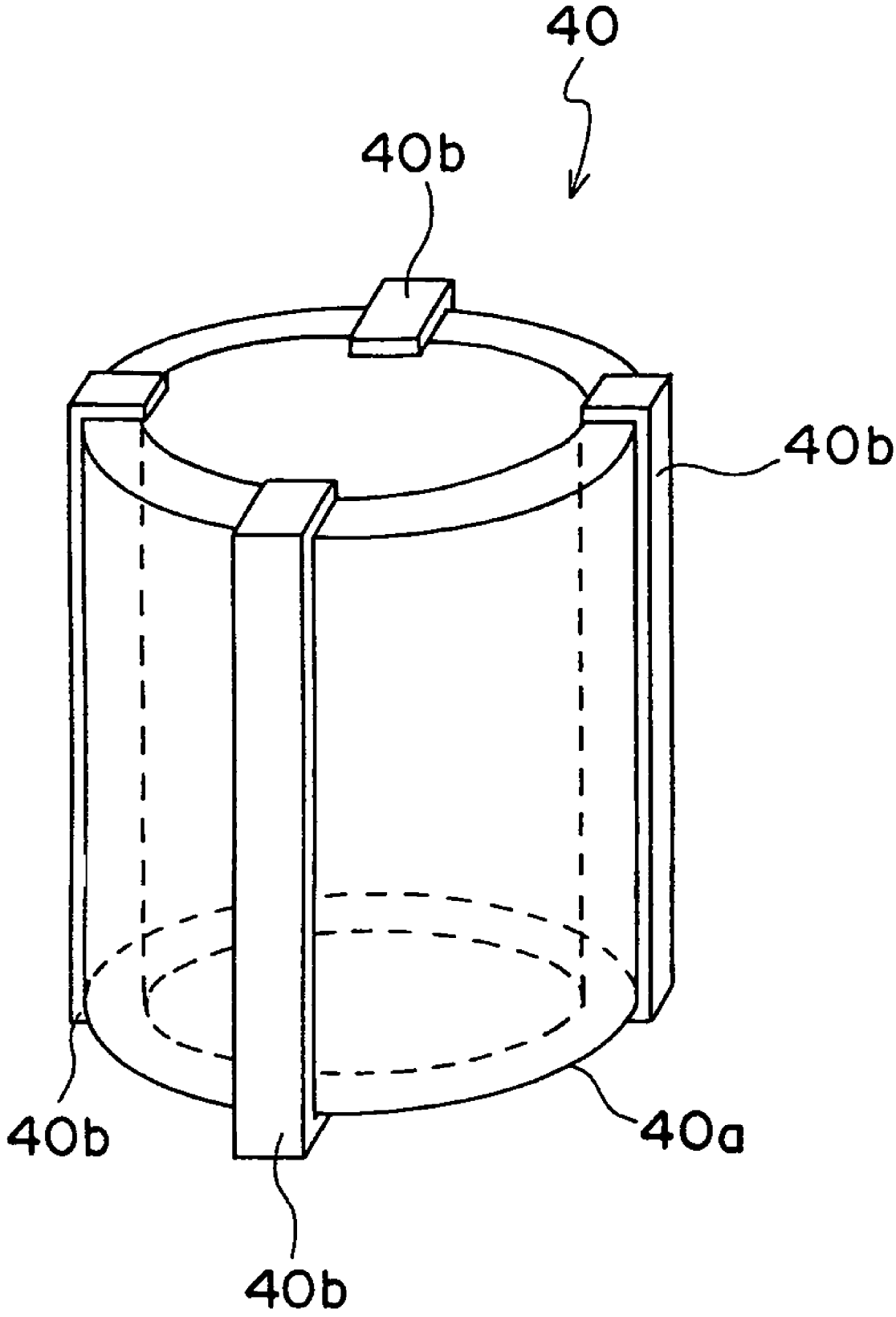
FIG. 4 is a view showing the configuration of a second heating coil.

A fourth heating coil 30 is provided in the vicinity of the adhesive supply section 18. The fourth heating coil 30 is configured so as to be able to receive a high-frequency current from a current supply device not shown. When the current flows through the fourth heating coil, an eddy current is generated in the adhesive supply section 18 made of a magnetic substance, and the adhesive supply section 18 itself is heated. The adhesive contained in the heated adhesive supply section receives the heat and melts. To converge the generated magnetic flux, the fourth heating coil 30 has a ferrite 32 and is provided with four "["-shaped ferrite cores as shown in FIG. 4.

Next, the sheet-binding process of the sheet-binding device in accordance with this embodiment will be described. FIGS. 5A–5E are views illustrating the general outline of the sheet-binding process carried out by the sheet-binding device in accordance with this embodiment.

Figures 5A, 5B, 5C, 5D, 5E:
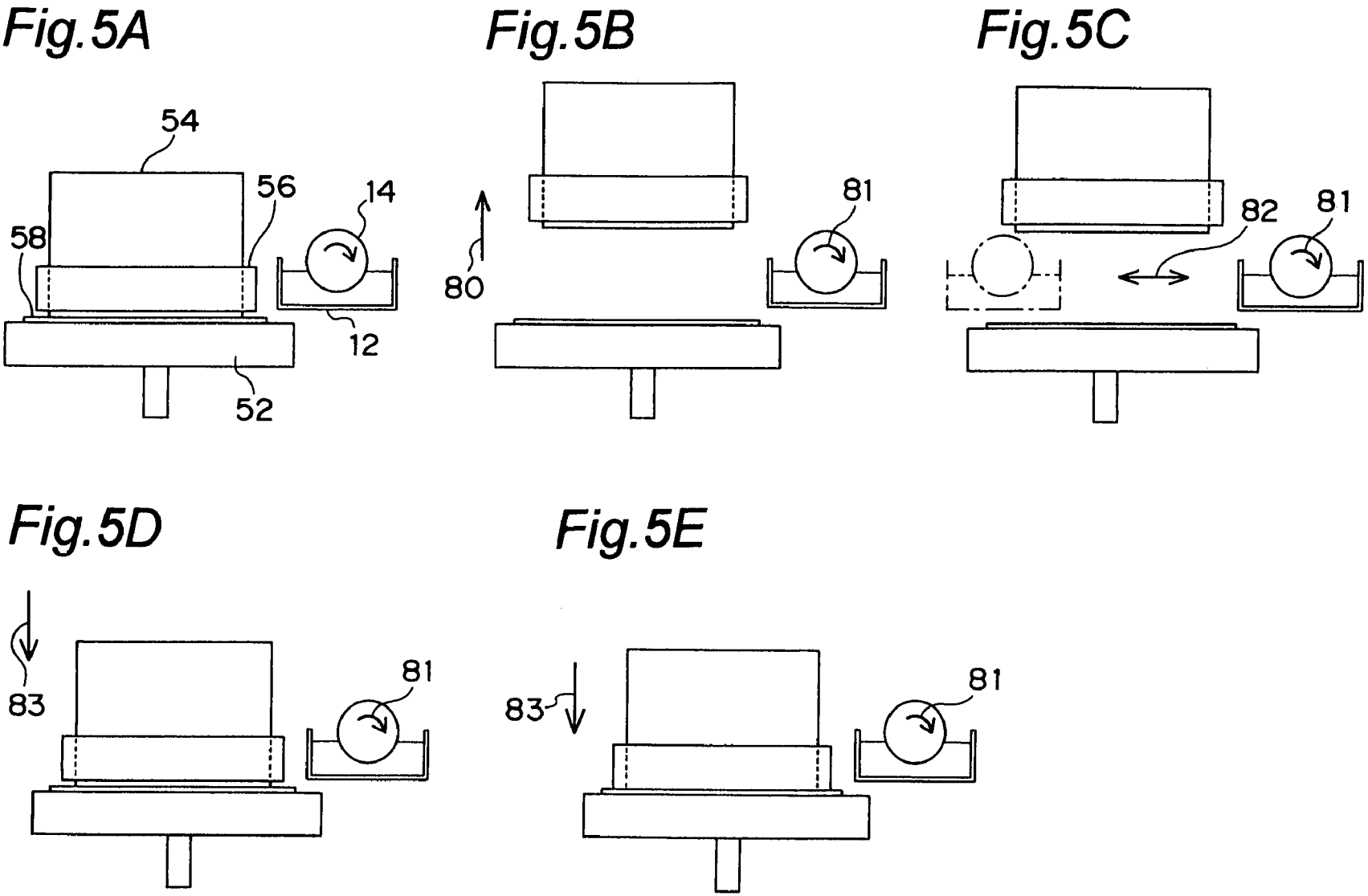
FIGS. 5A, 5B, 5C, 5D, 5E are views illustrating the general outline of the sheet-binding process carried out by the sheet-binding device in accordance with this embodiment.
Figure 6A:
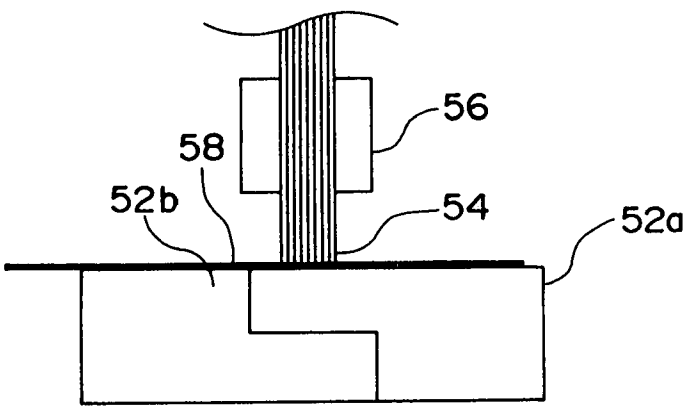
FIGS. 6A, 6B, 6C, 6D are views illustrating the general outline of the process shown in FIG. 5E.
Figure 6B:
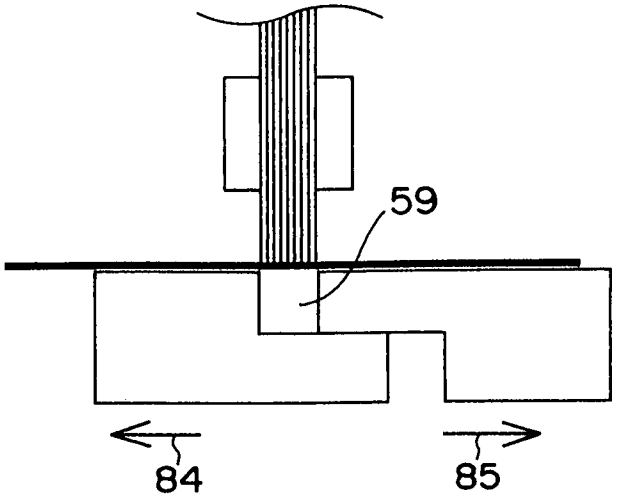
Figure 6C:
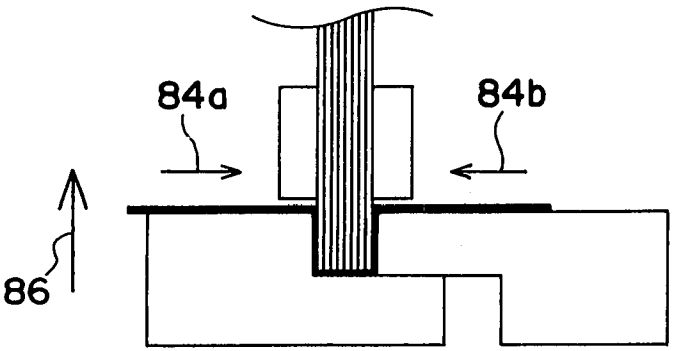
Figure 6D:
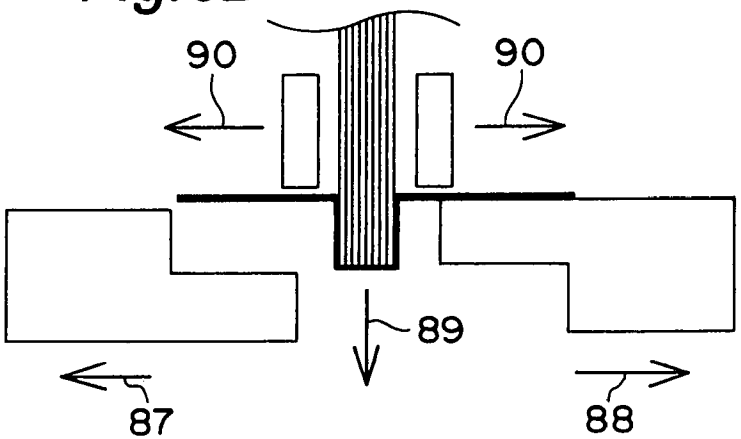

First, as shown in FIG. 5A, the one-side edge of a bundle of sheets 54, arranged so as to become the back of a book after sheet-binding, is set downward. At this time, a cover 58 has been set in advance on a base member 52, and while the bundle of sheets 54 placed thereon is checked so that sheet-binding is done as desired, a damper 56 is tightened to clamp the bundle of sheets. At this time, the base member 52 is in a closed state as shown in FIG. 6A; hence, the one-side edge of the bundle of sheets 54 should only be arranged on the upper portion thereof. After the bundle of paper sheets is clamped, the sheet-binding device enters a standby state wherein the coating roller rotating motor operates and the roller 14 on the adhesive reservoir 12 becomes a rotating state indicated by arrow 81; hereafter, the sheet-binding process described below starts.

When the sheet-binding process starts, the damper 56 moves upward as indicated by arrow 80 by a clamp up-down motor not shown while clamping the bundle of sheets 54 as shown in FIG. 5B. Next, after the damper 56 rises to the extent that the adhesive reservoir 12 can pass between the lower-side edge of the bundle of sheets 54 and the base member 52 as shown in FIG. 5C, the adhesive reservoir 12 reciprocates as indicated by arrow 82 so that the roller 14 rotated by a coating means sliding motor not shown makes contact with the lower-side edge of the bundle of sheets 54, whereby the adhesive stored in the adhesive reservoir 12 is applied. At this time, the first heating coil provided in the vicinity of the adhesive reservoir 12 is not moved, whereby wire processing to the first heating coil can be facilitated. By this reciprocating movement, strings between the adhesive on the lower-side edge of the bundle of sheets and the adhesive in the adhesive reservoir can be cut off. Furthermore, it is preferable that the clearance between the coating roller and the lower-side edge of the bundle of sheets and the rotation direction of the coating roller are made adjustable depending on the thickness of the bundle of sheets, the viscosity of the adhesive, etc. Still further, the clearance between the coating roller and the lower-side edge of the bundle of sheets and the rotation direction of the coating roller may be made variable depending on the movement direction of the adhesive reservoir.

When the adhesive reservoir 12 returns to its original position after the reciprocating movement under the bundle of sheets 54, the clamper 56 begins to lower as indicated by arrow 83, and the bundle of sheets 54 is bonded to the cover 58 as shown in FIG. 5D. FIG. 5E shows a state wherein after the bundle of sheets 54 is bonded to the cover 83, the bundle of sheets 54 is put into the clearance in the base member 52 and pressed in the left and right directions, as described in detail referring to the next figure, FIGS. 6A–6D.

FIGS. 6A–6D are views illustrating the general outline of the process shown in FIG. 5E. As shown in FIGS. 6A–6D, the bundle of sheets 54, the lower-side edge of which is coated with the adhesive, is bonded to the cover 58 when the damper 56 lowers. The base member comprises two L-shaped members 52*a* and 52*b* as shown in FIG. 6A, and these members are disposed so as to overlap and engage each other.

After the bundle of sheets 54 is bonded to the cover 58, the two members 52*a* and 52*b* of the base member are slid by base member sliding motors not shown and corresponding thereto, respectively, so as to be separated away from each other as indicated by arrows 84 and 85, respectively, whereby a clearance 59 is formed. With respect to what width the clearance 59 should have, since the thickness of the bundle of sheets 54 is known in advance by the damper 56, by outputting this signal and by subjecting it to calculation, the width may be determined; or it may be possible that the base members are slid to the maximum at first and then slid in directions so as to become close to each other, just as in the state described next and shown in FIG. 6C. However, the clearance 59 is required to be wider than the thickness of the bundle of sheets 54. The clearance 59 formed at this time has a bottom formed by the member 52*b*, whereby the lower-side edge of the bundle of sheets can be positioned by this.

After the clearance 59 is formed, the base member 52 moves upward, and the two members 52*a* and 52*b* thereof move as indicated by arrows 84*a* and 84*b*, thereby pressing the bundle of sheets 54 so as to hold it therebetween in the clearance 59. By this holding of the bundle of sheets 54 therebetween, the bonding can be made complete, and the thickness after the sheet-binding can be made thinner. At this time, the cover 58 is bent as shown in the figure along the clearance in the base member 52.

Since the bundle of sheets 54 is completely bonded to the cover 58 after the expiration of a predetermined time interval, the damper 56 releases the bundle of sheets as indicated by arrows 90. In addition, the members of the base member 52 are moved so as to open as indicated by arrows 87 and 88, respectively, whereby the bundle of sheets having been bonded drops as indicated by arrow 89.

As the above-mentioned sheet-binding process continues, the adhesive 10 in the adhesive reservoir reduces, whereby it becomes difficult to carry out the sheet-binding process properly; therefore, the adhesive is required to be supplied from the reservoir tank. The sheet-binding device in accordance with this embodiment has a sensor for this purpose, whereby the adhesive is supplied automatically.

FIG. 7 is a block diagram showing the control system of the sheet-binding device in accordance with this embodiment.

A CPU 60 is used to control the drive timing of all motors and the like by receiving information from all sensors and by carrying out processing and operation. A ROM 61 is a read-only memory for storing programs and data for the control of the CPU. A RAM 62 is a rewritable memory serving as the operation area of the CPU 60.

As shown in FIGS. 1 and 7, thermocouples 36 to 48 are provided for this sheet-binding device to detect the amount and temperature of the adhesive at predetermined intervals as described later. First and second thermocouples 36 and 38 are provided for the adhesive reservoir 12 to measure the amount and temperature of the adhesive in the adhesive reservoir 12. A third thermocouple 44 is provided for the adhesive supply section 18 to measure the temperature of the adhesive in the adhesive supply section. Fourth and fifth thermocouples 46 and 48 are provided for the reservoir tank 24 to measure the amount and temperature of the adhesive in the reservoir tank. The information measured by using these thermocouples is all transmitted to the CPU 60 at constant intervals.

As shown in FIG. 7, stop position sensors 71 to 75 described next are provided for the sheet-binding device. A first stop position sensor 71 is a sensor for detecting the position of the adhesive reservoir 12 that moves in the sheet-binding process as described referring to FIG. 5. A second stop position sensor 72 is a sensor for detecting the position of the damper when it moves up and down. Third and fourth stop position sensors 73, 74 are sensors for detecting the slide positions of the base members 52*a* and 52*b* as described referring to FIG. 6. A fifth stop position sensor is a sensor for detecting the position of the base member 52 when it is moved up and down. The positional information of all the members, detected by using these sensors, is transmitted to the CPU 60 at constant intervals.

A single high-frequency current supply source 51 supplies high-frequency currents to the first to fourth heating coils 20, 30, 40 and 50 at predetermined timing under the control from the CPU.

On the basis of the information from the thermocouples for measuring the temperature of the adhesive, the CPU 60 controls the high-frequency current supply source to keep the temperature of the adhesive in a range of 170° C.±5° C. and controls current supply to the first to fourth heating coils 20, 30, 40 and 50. The control is carried out to maintain this temperature range because, if the temperature is 165° C. or less, the viscosity of the adhesive is high and sheet-binding cannot be carried out properly, and if the temperature is more than 180° C., the adhesive may be burned.

Figure 8:
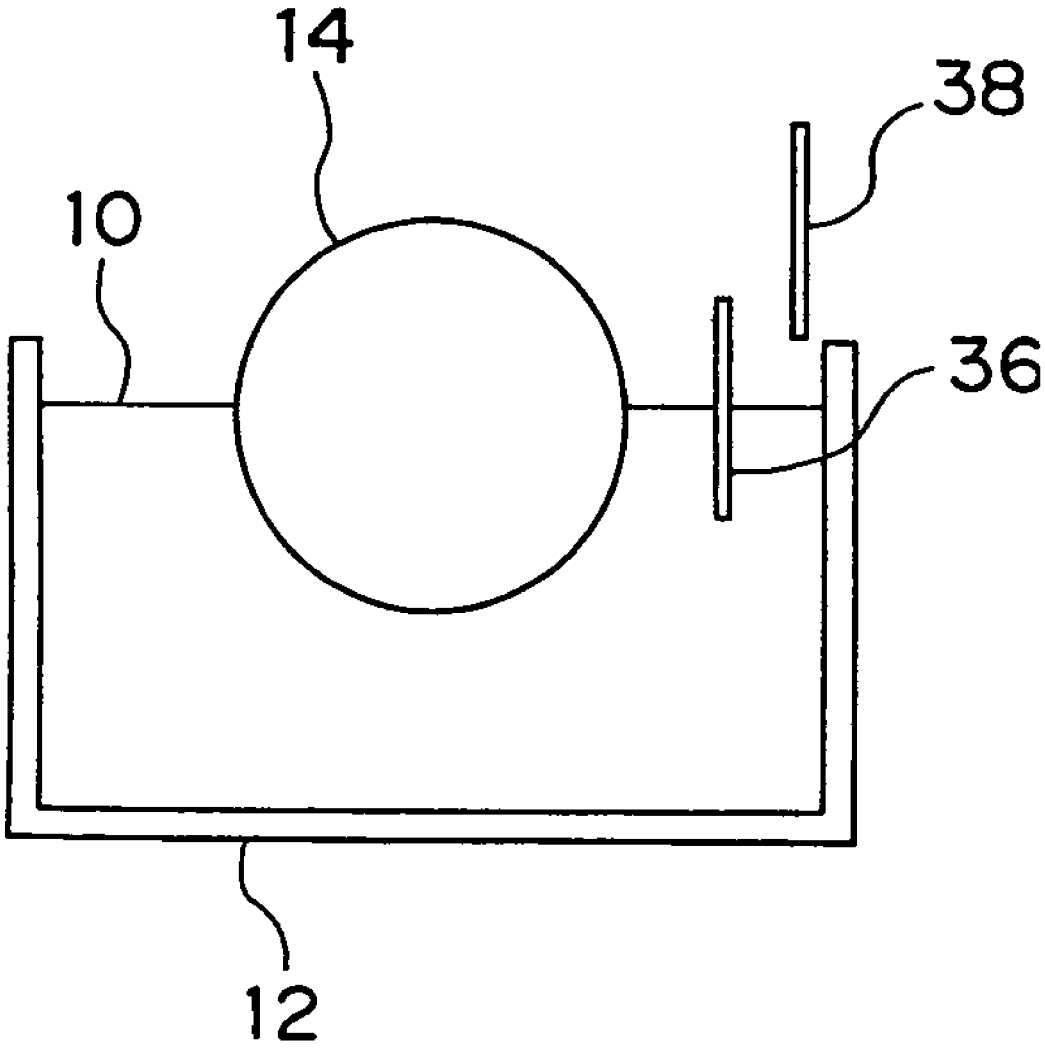
FIG. 8 is a view illustrating the positional relationship between first and second thermocouples 36 and 38.

FIG. 8 is a view showing the positional relationship between the first and second thermocouples 36 and 38. One of the two thermocouples provided for the adhesive reservoir 12 is disposed in the adhesive, and the other is disposed above the liquid level of the adhesive. When the adhesive remains sufficient, the measurement value of the thermocouple 36 is greatly different from the measurement value of the thermocouple 38. As the sheet-binding process proceeds and when the first thermocouple 36 becomes above the liquid level of the adhesive, the measurement value of the first thermocouple 36 becomes close to the measurement value of the second thermocouple 38. When the difference therebetween becomes smaller than a predetermined range stored in advance in the CPU 60, the CPU judges that the remaining amount of the adhesive 10 is scarce, thereby driving the gear pump 34 to supply the adhesive.

Figure 9:
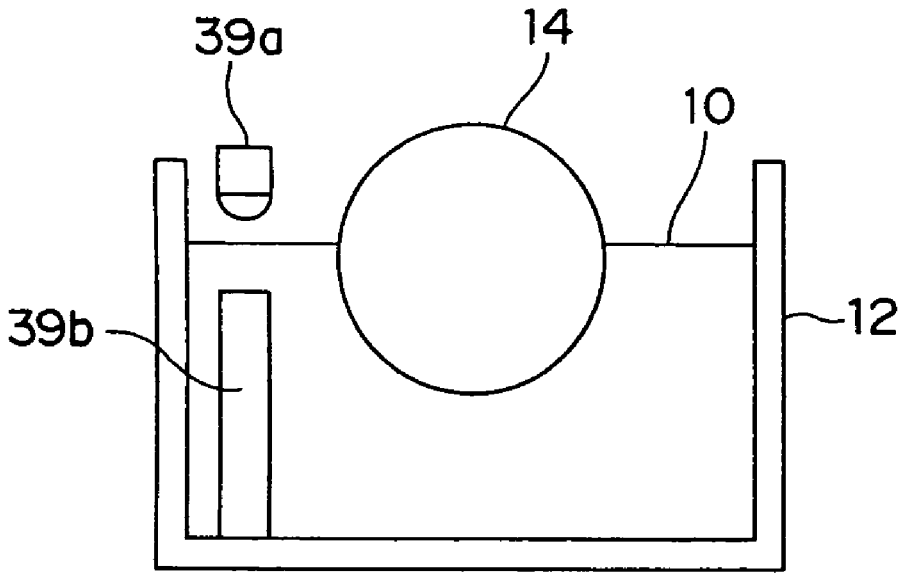
FIG. 9 is a view illustrating a case wherein a photosensor is used instead of the thermocouples to control the liquid level of adhesive.

FIG. 9 is a view illustrating a case wherein a photosensor is used instead of the thermocouples to control the liquid level of the adhesive. In this modified example, a photosensor 39*a* is disposed above the liquid level of the adhesive and emits infrared rays or the like at all times. A reflecting member 39*b* is provided at a position so as to face the light emitted from the photosensor 39*a*; when the remaining amount of the adhesive is sufficient, the reflecting member is disposed so as to be hidden below the liquid level of the adhesive; hence, the emitted infrared rays are reflected diffusely at the liquid level of the adhesive and scattered.

Figure 10:
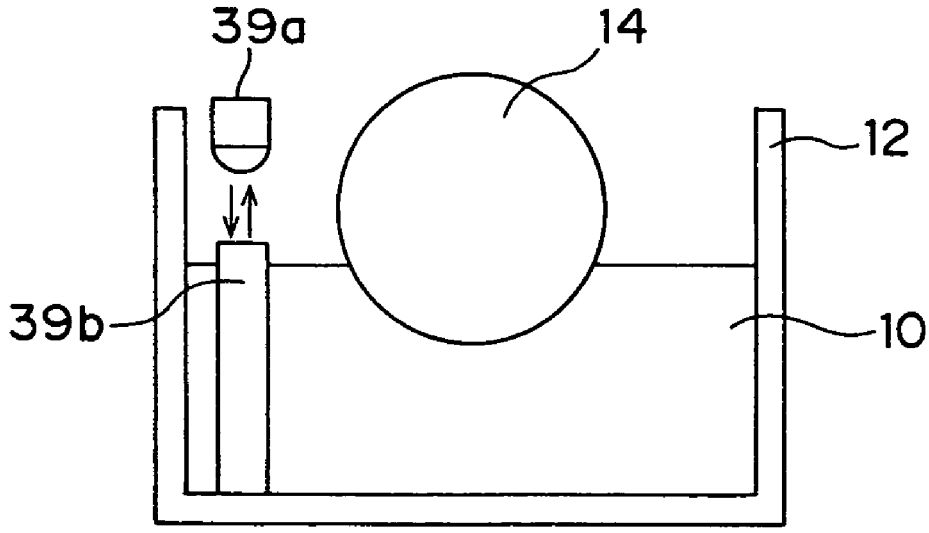
FIG. 10 is a view showing a state wherein the remaining amount of adhesive is scarce.

As the adhesive is used, the remaining amount reduces and the reflecting member 39*b* comes into sight above the liquid level of the adhesive as shown in FIG. 10; in this case, the light emitted from the photosensor 39*a* is reflected by the reflecting member 39*b* and enters the photosensor. Then, the photosensor 39*a* detects that the remaining amount of the adhesive is scarce and transmits the signal to the CPU 60.

Figure 11:
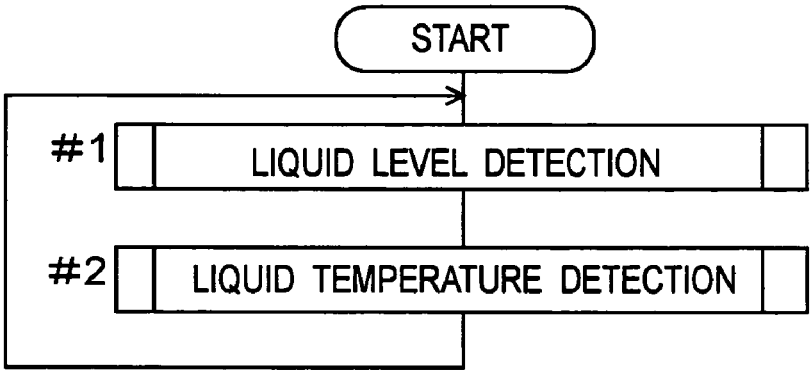
FIG. 11 is a view showing the processing sequence of a CPU.

Next, the whole control sequence of the CPU will be described. FIG. 11 is a view showing the processing sequence of the CPU. As shown in FIG. 11, the CPU repeats liquid level detection (step 1) and liquid temperature detection (step 2) on the basis of the signals transmitted from the thermocouples at predetermined intervals.

Figure 12:
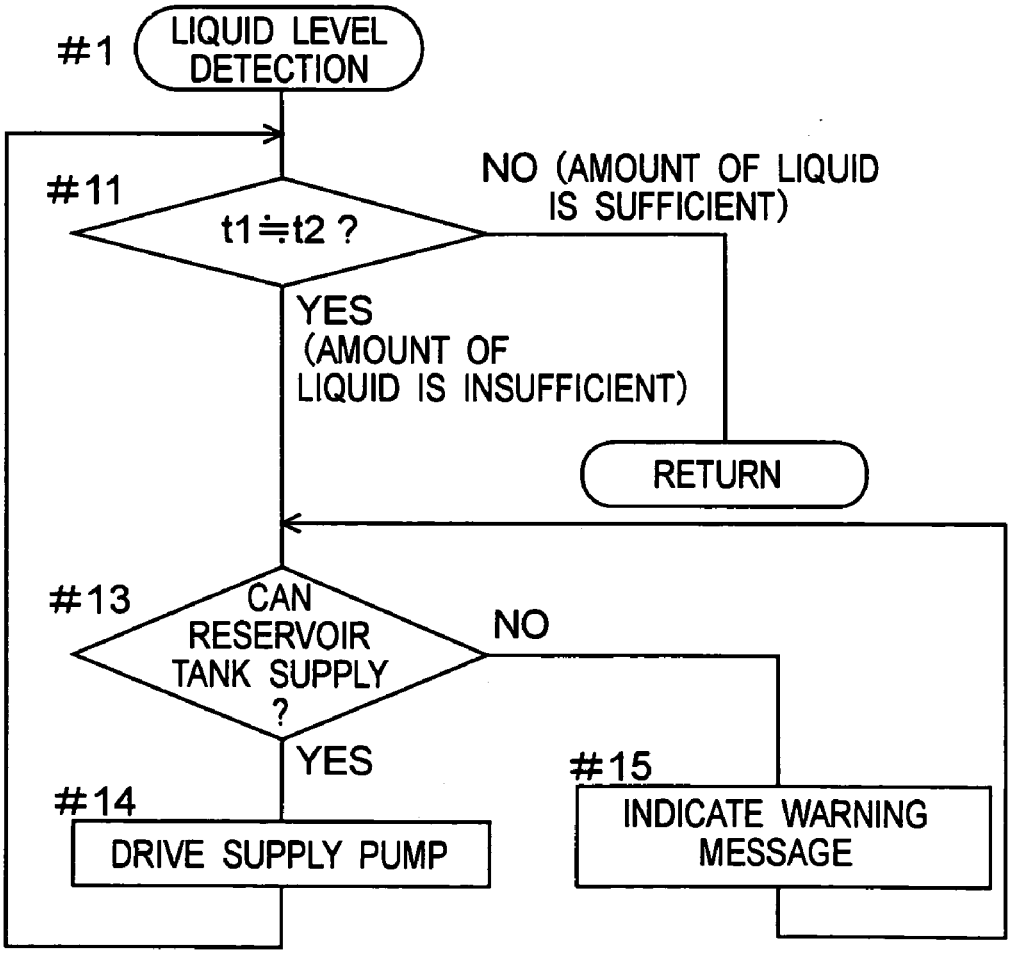
FIG. 12 is a flowchart showing a liquid level detection process.

FIG. 12 is a flowchart showing the liquid level detection process. First, the temperature ti of each of the thermocouples 38 and 48 disposed above the liquid level is detected at predetermined intervals, and a judgment is made as to whether the temperature is approximate to the temperature t2 of each of the thermocouples 36 and 46 disposed under the liquid level and used with those as a pair, respectively (step 11). In the case when the temperature of each of the thermocouples 38 and 48 is not approximate to the temperature t2 of each of the thermocouples 36 and 46 used with those as a pair, respectively, for measuring the temperature of the adhesive, it is determined that the remaining amount of the adhesive is sufficient, and the processing advances to the next liquid temperature detection (step 2). In the case when the temperature of each of the thermocouples 38 and 48 disposed above the liquid level is approximate to the temperature t2 of the adhesive used with those as a pair, respectively, it is determined that the remaining amount of the adhesive is insufficient, and a judgment is made as to whether the remaining amount of the adhesive in the reservoir tank 24 is sufficient and the adhesive can be supplied (step 13). In the case when the reservoir tank can supply the adhesive, the gear pump 34 for supplying the adhesive is driven (step 14). On the other hand, in the case when the reservoir tank cannot supply the adhesive, a warning message is indicated (step 15), whereby the user is urged to supply pellet-like adhesive to the reservoir tank.

Figure 13:
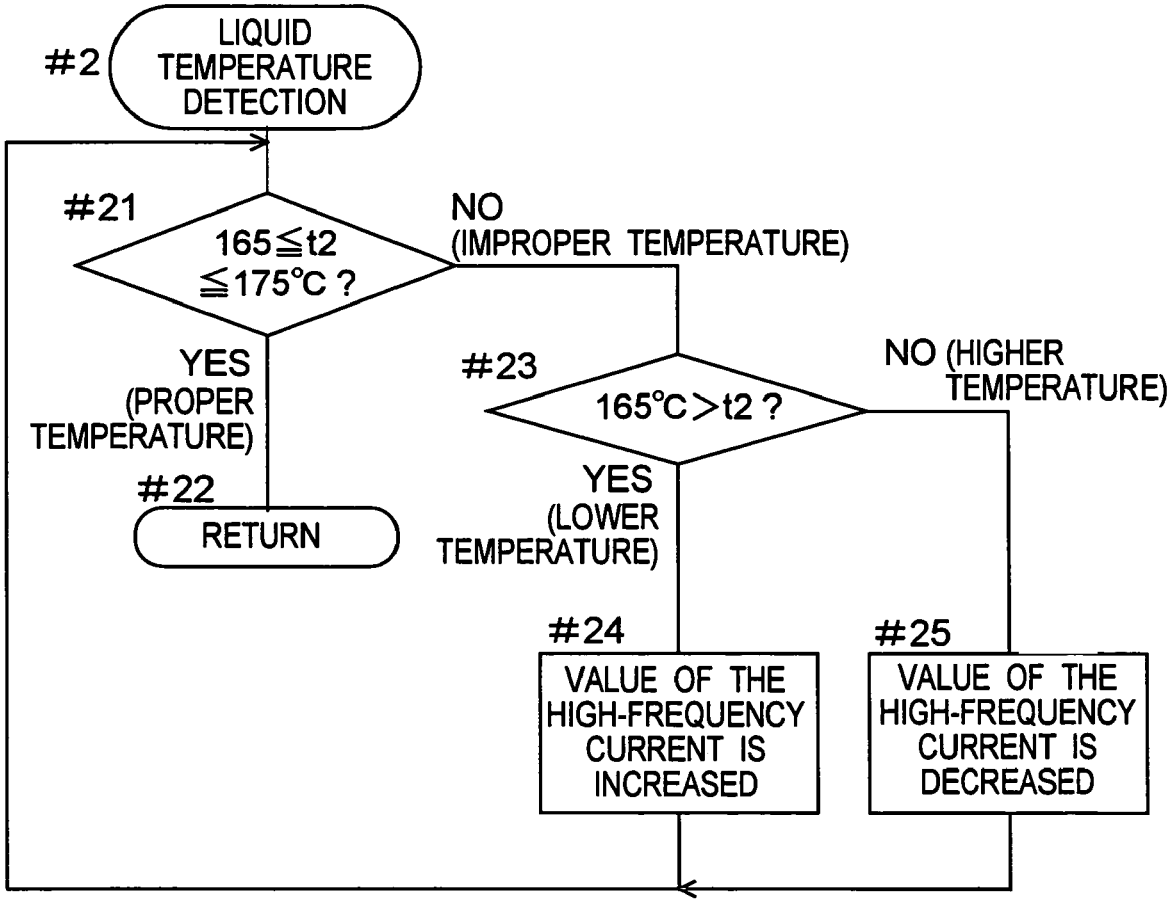
FIG. 13 is a flowchart showing the liquid temperature detection process.

FIG. 13 is a flowchart showing the liquid temperature detection process. The temperature t2 of each of the thermocouples 36, 44 and 46 for measuring the temperature of the adhesive at predetermined intervals is judged, a measurement is made as to whether the measurement value of each thermocouple is 165° C. or more and 175° C. or less (step 21). In the case when the measurement values of all the thermocouples are within this range, it is determined that the temperature is proper, and the processing advances to the liquid level detection process.

In the case when the measurement value of any one of the thermocouples is not within this range, a judgment is made as to whether the measurement value of the thermocouple is higher than 165° C. (step 23). In the case when the measurement value is lower than 165° C., it is determined that the temperature of the adhesive is lower than its proper value, and the value of the high-frequency current supplied to the heating coil corresponding to the thermocouple is increased (step 24). On the other hand, in the case when the measurement value is higher than 165° C., it is determined that the temperature of the adhesive is higher than its proper value, and the value of the high-frequency current supplied to the heating coil corresponding to the thermocouple is decreased (step 25).

Figure 14:
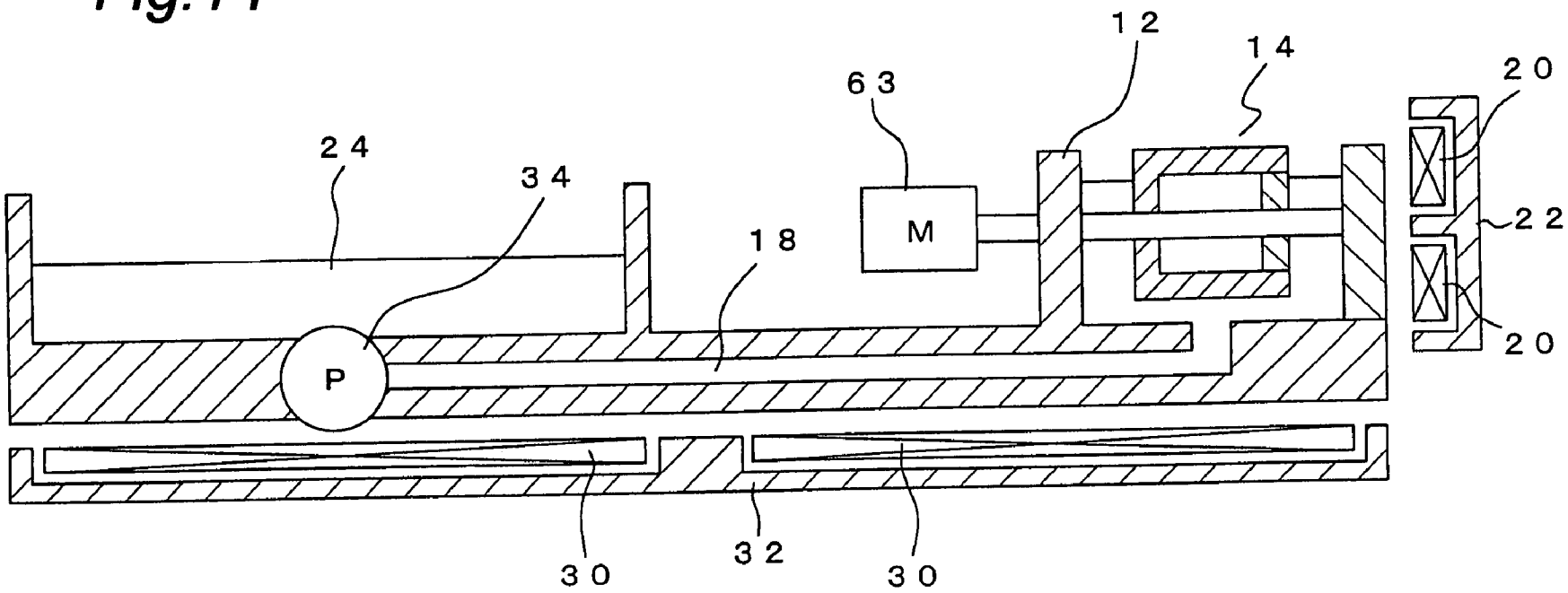
FIG. 14 is a view showing the main configuration of a sheet-binding device in accordance with a second embodiment of the present invention.

FIG. 14 is a view showing the main configuration of a sheet-binding device in accordance with a second embodiment of the present invention. This sheet-binding device comprises an adhesive reservoir 12 for storing hot-melt adhesive 10, a reservoir tank 24 for storing the adhesive to be, replenished and an adhesive supply section 18 for connecting the reservoir tank to the adhesive reservoir. In the adhesive reservoir 12, a roller 14 that is journaled by a shaft 16 so that at least part thereof is immersed in the adhesive stored inside the adhesive reservoir and that is rotatable around the shaft by a motor 63 connected to the shaft is provided.

On the extension of the shaft 16 of the roller 14, a heating coil 20 is provided. The first heating coil 20 is configured so as to be able to receive a high-frequency current from a current supply device not shown. When the high-frequency current flows through the first heating coil 20, a magnetic flux is generated around it. The magnetic flux generated by the heating coil generates an eddy current in the roller 14. By the eddy current flowing through the inside, the roller 14 itself becomes an electric resistor and generates heat depending on the amount of the current flowing through the heating coil.

The reservoir tank 24 is provided on the side of and in the vicinity of the adhesive reservoir. The reservoir tank 24 is formed in a low-profile shape having a small height dimension and a large bottom area. The reservoir tank is connected to the adhesive reservoir 12 via the adhesive supply section 18. The adhesive supply section has a low-profile shape configured so as to be integrated with the bottom face of the reservoir tank and is provided with a through hole, leading into the adhesive reservoir 12, for allowing the adhesive to flow therethrough. In addition, a gear pump 34 is provided in the middle of the through hole so that the adhesive can be supplied to the adhesive reservoir through the through hole. In other words, when the adhesive in the adhesive reservoir becomes scarce, the gear pump 34 is driven to feed the adhesive from the reservoir tank to the adhesive reservoir 12.

In the unit including the reservoir tank 24, the adhesive supply section 18, etc., each component is made of a magnetic substance, such as iron. Under this unit, a heating coil 30 is provided. This heating coil 30 has a ferrite core 32 so as to be able to converge a generated magnetic flux. In addition, the heating coil 30 is configured so as to be able to receive a high-frequency current from a current supply device not shown. Since the above-mentioned unit is configured to have a low-profile shape, when the high-frequency current flows through the heating coil 30, an eddy current flows in the whole unit owing to the high-frequency magnetic flux generated from the heating coil 30, whereby the whole unit is heated by the Joule heat therefrom.

With this configuration, the heating coils 20 and 30 to which wire processing is required can be disposed at fixed positions, and only the above-mentioned unit (the adhesive reservoir 12, the reservoir tank 24 and the adhesive supply section 18) can be slid. Therefore, wire processing for the whole device can be facilitated.

Industrial Applicability

As described above, in this sheet-binding device, an eddy current is generated in the roller by the heating coil provided in the vicinity of the roller, whereby the roller is directly heated; therefore, a time period until a standby state is attained can be shortened, and the temperature control of the adhesive can be carried out easily by simply adjusting current. In addition, since the heating coil does not make contact with the roller serving as a heating element, wire processing in the case when the roller is moved in the sheet-binding process can be facilitated.

The present invention is not limited to the above-mentioned embodiments but can be embodied in other various modes of embodiments.

What is claimed is:

1. An adhesive coating device comprising:

a roller, part of which is immersed in adhesive stored in an adhesive reservoir, for applying the adhesive hot-melted in said adhesive reservoir along an arranged one-side edge of a bundle of sheets while rotating;

an electromagnetic induction heating coil disposed in a vicinity of said roller; and a current supply device for supplying a high-frequency current to said electromagnetic induction heating coil, wherein said roller is formed of a heating member for generating heat using a Joule heat owing to an eddy current caused by a high-frequency magnetic flux generated by said electromagnetic induction heating coil, and said current supply device supplies the current to said electromagnetic induction heating coil so as to heat said roller so that the adhesive stored in said adhesive reservoir is melted by said roller.

2. The adhesive coating device in accordance with claim 1, wherein said electromagnetic induction heating coil is disposed in a direction of a rotation shaft of said roller, and said roller is configured so as to be hollow, and a side face thereof on a side wherein said electromagnetic induction heating coil is provided is made of a nonmagnetic substance.

3. The adhesive coating device in accordance with claim 1, wherein a core is disposed in a vicinity of said electromagnetic induction heating coil.

4. The adhesive coating device in accordance with claim 1, further comprising a reservoir tank for replenishing adhesive.

5. The adhesive coating device in accordance with claim 4, further comprising:

an adhesive detecting device for an amount of said adhesive stored in said reservoir;

a replenishing member, disposed in an adhesive supply passage for connecting said reservoir tank to said adhesive reservoir, for replenishing said adhesive stored in said reservoir tank into said adhesive reservoir; and a replenishing control device for properly keeping a replenishing amount of said adhesive by receiving a signal from said adhesive amount detecting device and by driving said replenishing member.

6. The adhesive coating device in accordance with claim 4, wherein a screw-shaped stirring member is provided in said reservoir tank.

7. The adhesive coating device in accordance with claim 4 further comprising:

a second electromagnetic induction heating coil disposed in a vicinity of said reservoir tank; and a second current supply device for supplying a high-frequency current to said second electromagnetic induction heating coil, wherein said reservoir tank is formed of a heating member for generating heat using a Joule heat owing to an eddy current caused by a high-frequency magnetic flux generated by said electromagnetic induction heating coil, and said second current supply device supplies the current to said second electromagnetic induction heating coil so as to heat said reservoir tank.

8. The adhesive coating device in accordance with claim 6, further comprising:

a third electromagnetic induction heating coil disposed inside said stirring member; and a third current supply device for supplying a high-frequency current to said third electromagnetic induction heating coil, wherein said stirring member is formed of a heating member for generating heat using a Joule heat owing to an eddy current caused by a high-frequency magnetic flux generated by said electromagnetic induction heating coil, and said third current supply device supplies the current to said third electromagnetic induction heating coil so as to heat said stirring member.

9. The adhesive coating device in accordance with claim 5, further comprising:

a fourth electromagnetic induction heating coil disposed in a vicinity of said adhesive supply passage; and a fourth current supply device for supplying a high-frequency current to said fourth electromagnetic induction heating coil, wherein at least part of said adhesive supply passage is formed of a heating member for generating heat using a Joule heat owing to an eddy current caused by a high-frequency magnetic flux generated by said electromagnetic induction heating coil, and said adhesive supply passage is heated by supplying a current from said fourth current supply device to said fourth electromagnetic induction heating coil.

10. An adhesive coating device in accordance with any one of claims 1, 7, 8 and 9, wherein said heating member is made of a material having a volume resistivity of 5 to 150 Ω·m and a magnetic permeability $\mu$ of 10 or more.

11. The adhesive coating in accordance with claim 7, wherein a core is disposed in a vicinity of said second electromagnetic induction coil.

12. The adhesive coating in accordance with claim 7, wherein a core is disposed inside said second electromagnetic induction heating coil.

13. The adhesive coating in accordance with claim 8, wherein a core is disposed in the vicinity of said third electromagnetic induction heating coil.

14. The adhesive coating in accordance with claim 8, wherein a core is disposed inside said third electromagnetic induction heating coil.

15. The adhesive coating in accordance with claim 9, wherein a core is disposed in a vicinity of said fourth electromagnetic induction coil.

16. The adhesive coating in accordance with claim 9, wherein a core is disposed inside said fourth electromagnetic induction oil.

17. The adhesive coating in accordance with claim 9, wherein said adhesive supply passage includes a meandered part and said fourth electromagnetic induction heating coil is disposed in a vicinity of the meandered part of said adhesive supply passage.

18. The adhesive coating device in accordance with claim 1, further comprising a moving member for moving said roller, wherein said roller is moved by said moving member to apply said adhesive to a back of said bundle of sheets fixed at a predetermined position.

19. The adhesive coating device in accordance with claim 18, wherein said moving member is operable to move a coating unit including said roller and said adhesive reservoir.

20. The adhesive coating device in accordance with claim 19, wherein said coating unit does not include said first electromagnetic induction heating coil.

* * * * *